US007597580B1

(12) United States Patent
Advey et al.

(10) Patent No.: US 7,597,580 B1
(45) Date of Patent: Oct. 6, 2009

(54) CONNECTOR WITH TERMINAL MOTION REDUCTION

(75) Inventors: Alexander J. Advey, Ypsilanti, MI (US); John J. Hasija, Saline, MI (US); Semere T. Tesfay, Westland, MI (US); Rajesh L. Chidambarakrishnan, Canton, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 12/232,406

(22) Filed: Sep. 17, 2008

(51) Int. Cl.
*H01R 13/648* (2006.01)

(52) U.S. Cl. ..... 439/383; 439/272

(58) Field of Classification Search ..... 439/79, 439/587, 589, 274, 275, 272, 383
See application file for complete search history.

(56) References Cited

U.S. PATENT DOCUMENTS

| | | | | |
|---|---|---|---|---|
| 4,457,570 | A | 7/1984 | Bogese, II | |
| 4,629,273 | A * | 12/1986 | Van Camp | 439/272 |
| 4,735,581 | A | 4/1988 | Endo et al. | |
| 5,478,261 | A | 12/1995 | Bogese, II | |
| 5,575,672 | A | 11/1996 | Katsuma | |
| 5,725,386 | A | 3/1998 | Davis et al. | |
| 5,779,489 | A | 7/1998 | Davis et al. | |
| 5,911,595 | A | 6/1999 | Orr, Jr. et al. | |
| 6,033,247 | A | 3/2000 | Gregory, II | |
| 6,183,275 | B1 | 2/2001 | Okura et al. | |
| 6,302,734 | B1 | 10/2001 | Ichio et al. | |
| 6,443,766 | B2 | 9/2002 | Ichio et al. | |
| 6,482,035 | B2 | 11/2002 | Okabe et al. | |
| 6,527,579 | B2 | 3/2003 | Sato et al. | |
| 6,527,586 | B2 | 3/2003 | Okamura et al. | |
| 6,746,258 | B2 | 6/2004 | Kikuchi et al. | |
| 6,752,659 | B2 | 6/2004 | Nakamura et al. | |
| 6,997,726 | B2 | 2/2006 | Buden et al. | |
| 7,134,901 | B2 | 11/2006 | Okura | |
| 7,201,609 | B2 | 4/2007 | Ishikawa | |
| 7,214,080 | B2 | 5/2007 | Ichio et al. | |
| 7,249,958 | B2 | 7/2007 | Ishikawa et al. | |
| 2006/0240716 | A1 | 10/2006 | Kozono et al. | |
| 2007/0020978 | A1 | 1/2007 | Murakami et al. | |
| 2007/0270001 | A1 | 11/2007 | Matsumura | |
| 2007/0275599 | A1 | 11/2007 | Sugiyama et al. | |

* cited by examiner

*Primary Examiner*—Javaid Nasri
(74) *Attorney, Agent, or Firm*—Daniel R. Edelbrock

(57) ABSTRACT

A connector assembly has a first part with an interior for receiving right-angle electrical terminals through an insertion end. Wire-connect segments of the terminals seat within cradle-like members aligned in sets of rows extending across the width of the interior. Electrical mating segments of the terminals extend perpendicularly from the wire-connect segments. A second part of the connector assembly has chambers for receiving the mating segments of the terminal and a compartment with inner cradle-like members aligned in sets of rows across the compartment. The cradle-like members of the first and second parts are arranged to correspond in position to each other when the second part is assembled on the first part so the wire-connect segments are clamped within the cradle-like members, reducing vibrational and other motion of the terminals within the assembly.

20 Claims, 5 Drawing Sheets

CONNECTOR WITH TERMINAL MOTION REDUCTION

BACKGROUND OF THE INVENTION

1. Field of the Invention

The invention relates in general to an electrical connector for housing right-angle electrical terminals and more particularly to a connector with internal features for reducing movement of the terminals after assembly.

2. Discussion of Related Art

Electrical connectors in vehicles are subject to vibration and other motion caused by vehicle movement. Cracking in the plastic connector parts and dielectric failure of the electrical connection are possible if the motion is not controlled. Attempts have been made in the art to reduce motion of the terminals. FIG. 1 illustrates part of a prior art electrical connector 12 for receiving right angle electrical terminals 14. The terminals 14 have wire-connect segments 16 attached by crimping or other methods to electrical wires 18. Electrical mating segments 20 extend at ninety degrees from the wire-connect segments 16. The terminals 14 are limited in movement within the connector 12 by the dimensional characteristics of the inner cavity walls 22 surrounding the wire-connect segments 16, chamber walls 24 closely spaced around the mating segments 20, and complimentary latch features 26 on the connector and mating segments. Liquid epoxy or resin (not shown) is injected or poured between the cavity walls 22 around the terminals to provide a water resistant seal that further stabilizes the terminals when the resin is hardened and cured. The resin requires preparation time, special equipment and handling, and curing time that can take a few hours. This significantly increases the assembly time and cost of the connector. The terminals are difficult or impossible to remove from the connector after the resin is cured.

SUMMARY OF THE INVENTION

Accordingly, it is an object of this invention to provide a connector assembly with built-in motion reduction members for limiting movement of right-angle electrical terminals held within the assembly.

Another object of the invention is to ease the assembly process by including retention features to hold the terminals in position as the motion reduction features are assembled around the terminals.

A further object of the invention is to efficiently seal the assembly around the motion reduction features to protect the terminal wire connections without the use of epoxies or resins.

In carrying out this invention in the illustrative embodiment thereof, the motion of the right-angle electrical terminals within a high-voltage connector assembly is limited by resilient cradle-like members supporting the terminals. The terminals are placed in the cradle-like members in a first housing part. A recessed ledge surrounds the cradle-like members. A retention feature in the first housing part comprises a groove on each side of the terminal for receiving protrusions jutting out from the terminal. A deflectable projection in each groove snaps over the terminal protrusions to lock the terminals in position when the terminals are fully seated. The terminals are prevented from being pulled at an angle ninety degrees from the vertical orientation or direction of the grooves.

A second housing part has additional cradle-like members for alignment with the cradle-like members in the first part. The cradle-like members of the second part extend from a raised portion of a base of the second part. The raised portion is sized and arranged to fit against a seal placed on the recessed ledge of the first housing part when the second housing part is assembled on the first housing part. Simultaneously, the wire-connect segments of the terminals are clamped between the cradle-like members of both housing parts as the parts are locked together. Vibration and other motion of the terminals caused by vehicle movement are reduced or eliminated.

BRIEF DESCRIPTION OF THE DRAWINGS

This invention, together with other objects, features, aspects and advantages thereof, will be more clearly understood from the following description, considered in conjunction with the accompanying drawings.

DETAILED DESCRIPTION OF THE ILLUSTRATED EMBODIMENT

Figure 1:
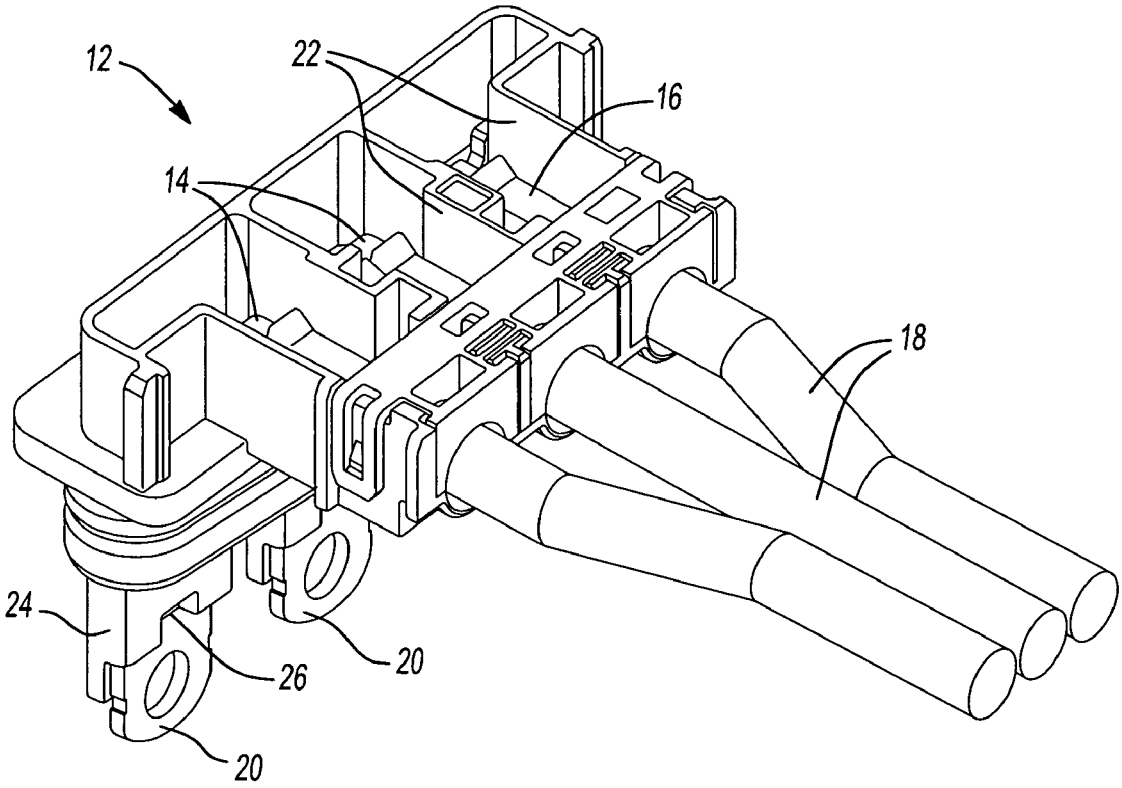
Fig-1 PRIOR ART
FIG. 1 is an illustration of a prior art terminal motion reduction system.
Figure 2:
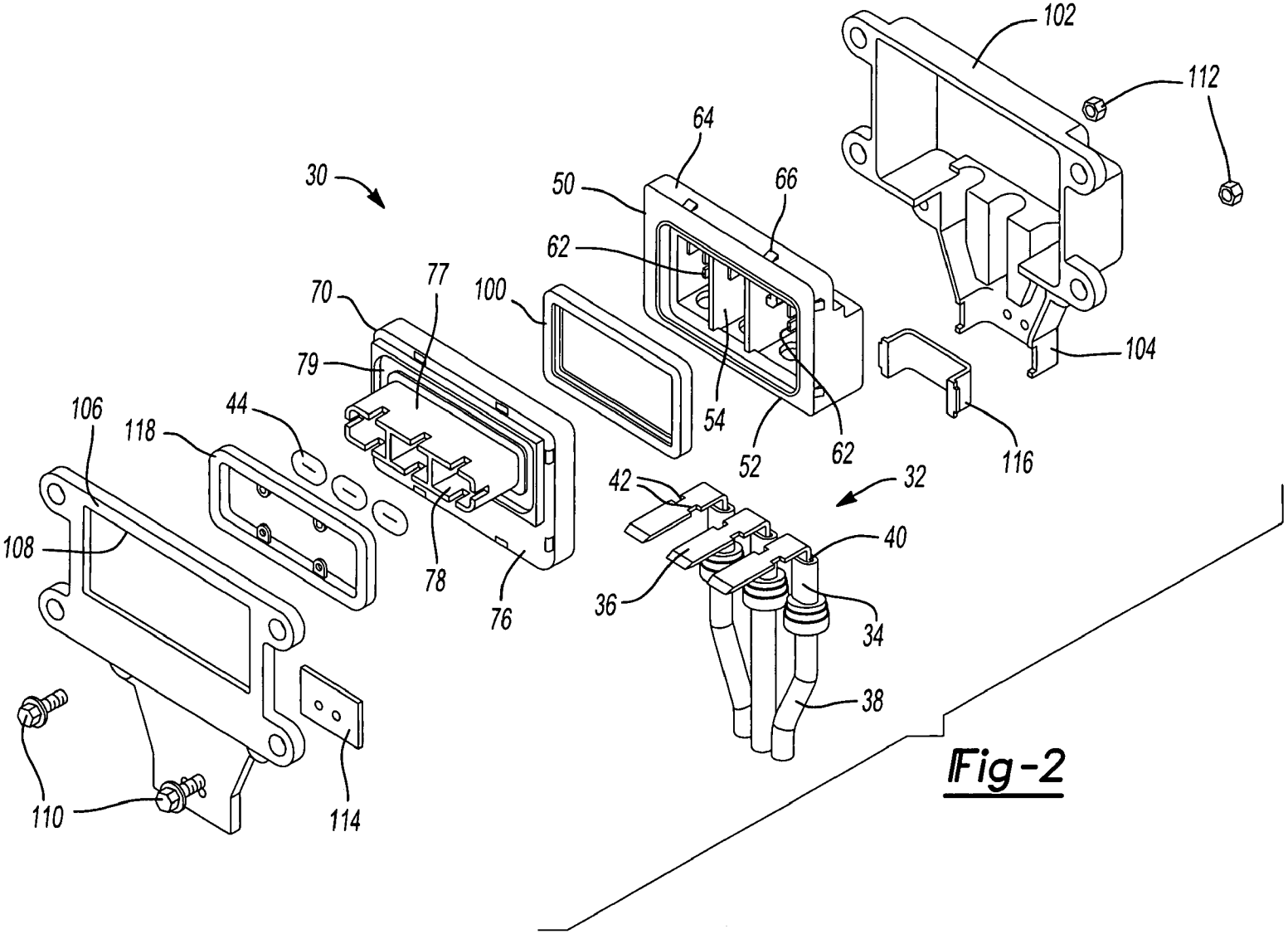
FIG. 2 is an exploded perspective view of a connector assembly according to the present invention.

Referring now to FIG. 2, a connector assembly 30 according to the present invention is illustrated in an exploded view. The connector assembly 30 is meant to receive and secure right-angle or ninety degree electrical terminals 32. Each terminal comprises a wire-connect portion or segment 34 and an electrical mating portion or segment 36. The mating segment 36 is illustrated for example purposes as a male contact blade, but may alternatively be a female receptacle depending on the connector assembly design and function. The wire-connect segment 34 is crimped or mechanically and electrically attached by some other method to an electrical wire 38. The electrical mating segment 36 extends at a right angle from the wire-connect segment 34. The wire-connect segment 34 has protrusions 40 the purpose of which will be later described. The mating segment 36 includes notches 42 on each edge for receiving small, resilient o-rings 44 to help seal the wire connection from water and other contaminants.

Figure 3:
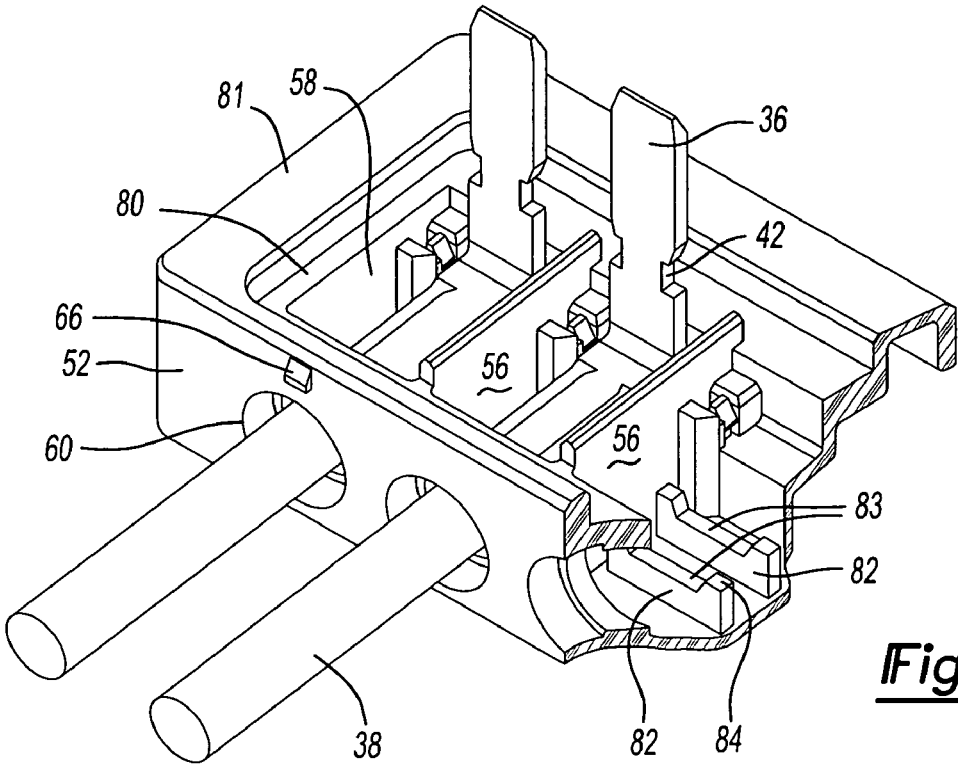
FIG. 3 is a cut-away view of the motion reduction feature in a first part of the connector assembly.

As best shown in FIGS. 2 and 3, the connector assembly has a main first part or housing 50 with a terminal insertion end 52 and an interior 54 divided by walls 56 into cavities 58. Each cavity 58 receives a terminal 32 through a wide hole 60 in the insertion end 52. Motion reduction features 62 within the cavities 58 support and stabilize the terminals 32, as will be further explained. The first part 50 has an outer periphery 64 with spaced locking tabs 66 for securing the first connector part or housing 50 to a second connector part or housing 70.

Figure 4:
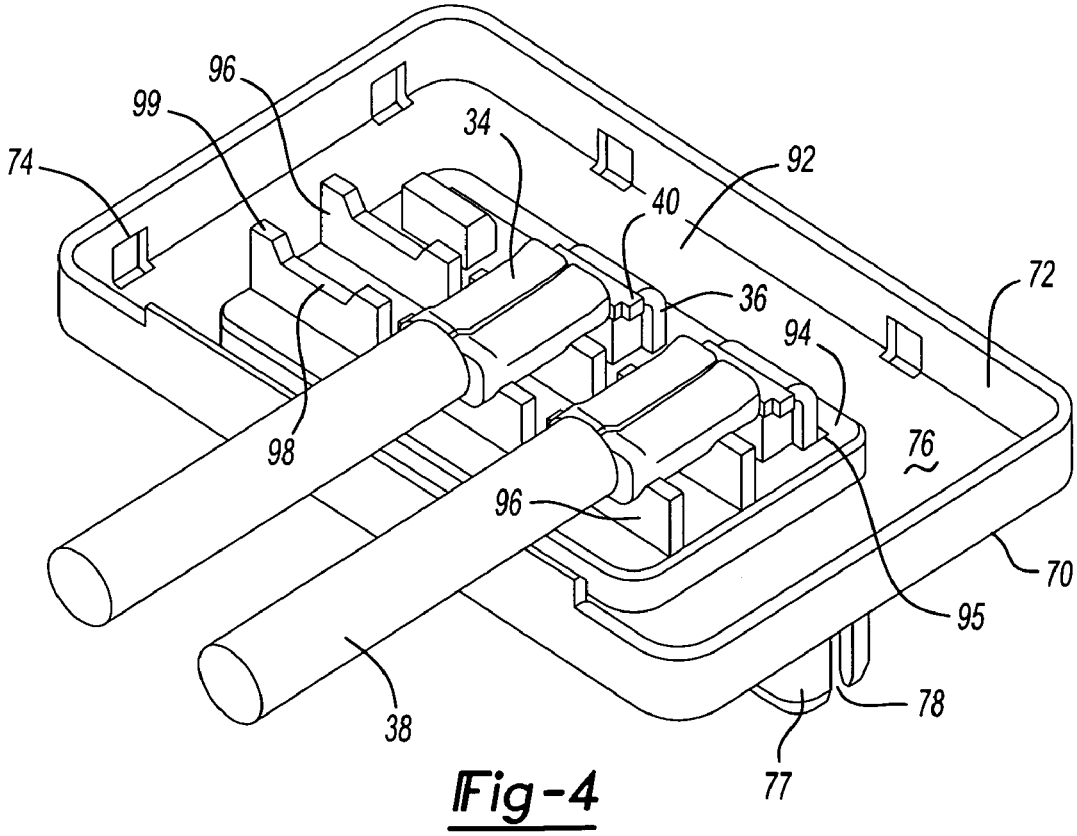
FIG. 4 depicts the motion reduction features on an underside of a second part of the connector assembly, conceptualized to show how they would fit around electrical terminal wire-connect segments when the first part is assembled on the second part.

The second connector part 70, as illustrated in FIGS. 2 and 4, has an outer frame 72 with spaced locking apertures 74. The first and second connector parts are molded from a suitable, electrically non-conductive plastic such as Syndiotactic Polystyrene. The frame 72 is sized and configured to fit around the outer periphery 64 of the first connector part 50 with the locking apertures 74 snapping around the locking tabs 66 to secure the parts together. The second part 70 includes a base section 76 formed as an inner portion of the frame 72 and a terminal chamber section 77 extending from the base section. The chamber section 77 receives the mating segments 36 of the terminals 32 in terminal accommodating chambers 78 after the wire-connect segments 34 are seated in the first connector part 50. A trough or channel 79 in the base section 76 extends around the chamber section 77.

The interiors of the first and second connector parts are best shown in FIGS. 3 and 4, respectively. The first part 50 has a recessed ledge 80 surrounding the interior 54 at a short depth inward from an outer surface 81 perpendicular to the terminal insertion end 52. The motion reduction features 62 in the first part 50 comprise cradle-shaped elements or members 82 sized and configured to receive and support the wire-connect segments 34 of the terminals 32. The cradle-shaped members 82 are somewhat elastic or resilient because of their small size. The members 82 have substantially concave seating surfaces 83, extending inward from top or upper surfaces 84, and are aligned in a row for supporting the wire-connect segment 34 along its length. There are sets of rows extending across a width of the first part 50 to support multiple terminals 32. Each row contains two members 82 as illustrated, but there may be more or fewer members 82 depending on the desired length of each member 82 and the length of the wire-connect segment 34. Three sets of members 82 would be formed across the width of the first part in the example illustrated (two sets are hidden in FIG. 3 by the wire-connect segments 34 of the terminals 32, but can be partially seen in FIG. 2). However, there may be more or less sets depending on the number of terminals meant to be held within the particular connector assembly design.

Figure 5:
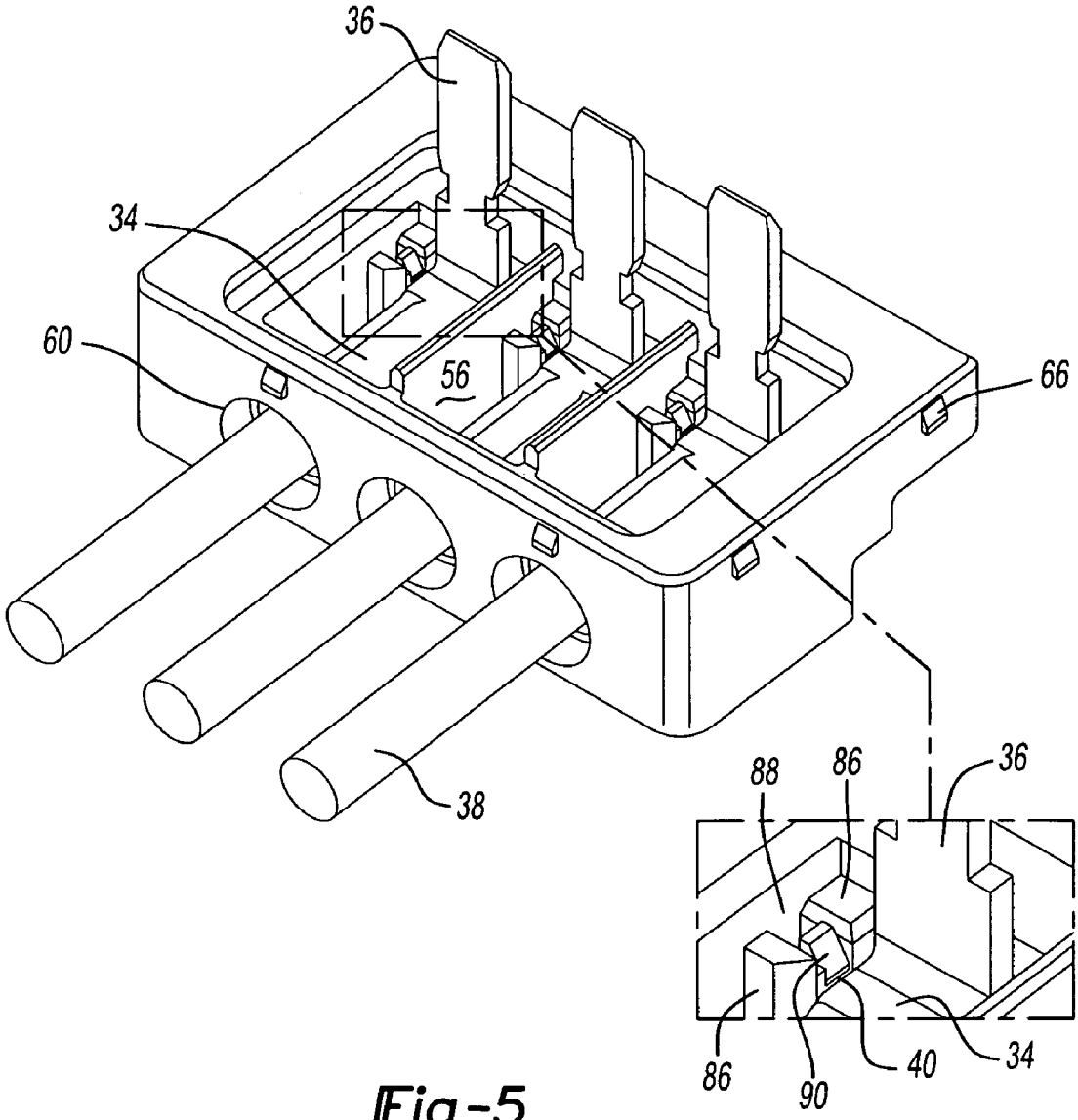
FIG. 5 is a close-up view of an initial or pre-set terminal retention feature for use in combination with the motion reduction feature.

The cradle-shaped elements or members 82 are formed integrally with the first connector part 50 during the molding process. Terminal retention features are also formed during manufacturing to hold the terminals in position on the members 82 until the second connector part 70 is assembled on the first connector part. These retention features are depicted in FIG. 5 and comprise spaced blocks 86 formed on the walls 56 and the sides of the interior 54. The blocks 86 form vertical (as oriented in FIG. 5) grooves 88 between them. The grooves 88 receive the protrusions 40 extending from the sides of the wire-connect segments 34 of the terminals 32 adjacent to where the wire-connect segments join the mating segments 36. The mating segments 36 of the terminals 32 are first inserted through the holes 60. The terminals 32 are slightly turned or rotated so the wire-connect segments 34 are in-line with the cavities 58 and then pushed into the cavities. As the protrusions 40 are aligned with and dropped into the grooves 88, the wire-connect segments 34 seat in the cradle-shaped members 82. Latch means, comprising deflectable locking arms 90 extending within and along the grooves 88 from a bottom of the interior 54, simultaneously snap back over the protrusions 40 as they pass by to lock the terminals in place.

As illustrated in FIG. 4, an inner compartment 92 within the second connector part or housing 70 has a raised platform or portion 94 extending from the base section 76 and sized and shaped to fit into the first connector part 50 onto the recessed ledge 80. Slots 95 in the raised portion 94 communicate with or lead to the terminal accommodating chambers 78. Cradle-shaped elements or members 96 project from the raised portion 94 in sets of rows arranged and configured to substantially match in size and correspond in position to the members 82 within the first part 50. The cradle-shaped members 96 have concave seating surfaces 98 directed inward from top or upper surfaces 99.

FIG. 4 is meant to show the structure within the second part 70 and demonstrate conceptually how it receives the terminals 32. However, the terminals are not placed in the second part 70. The terminals are inserted into the first connector part 50 as previously described. A resilient seal or gasket 100 is placed on the raised portion 94 of the second part 70. Then the second part 70 is assembled on the first part 50. The chamber section 77 of the second part 70 receives the mating segments 36 of the terminals 32 through the slots 95. The cradle-shaped members 96 fit around the wire-connect segments 34 of the terminals as the gasket 100 provides a seal between the recessed ledge 80 and the raised portion 94. The locking tabs 66 on the outer periphery 64 of the first part snap into the locking apertures 74 on the outer frame 72 of the second part 70. The corresponding cradle-shaped members 82 and 96 clamp around the wire-connect segments 34 of the terminals 32 and significantly reduce any further movement or vibration of the terminals 32. The members 82 and 96 don't necessarily need to exactly align vertically to provide clamping action, but such alignment would improve the motion reduction performance.

Figure 6:
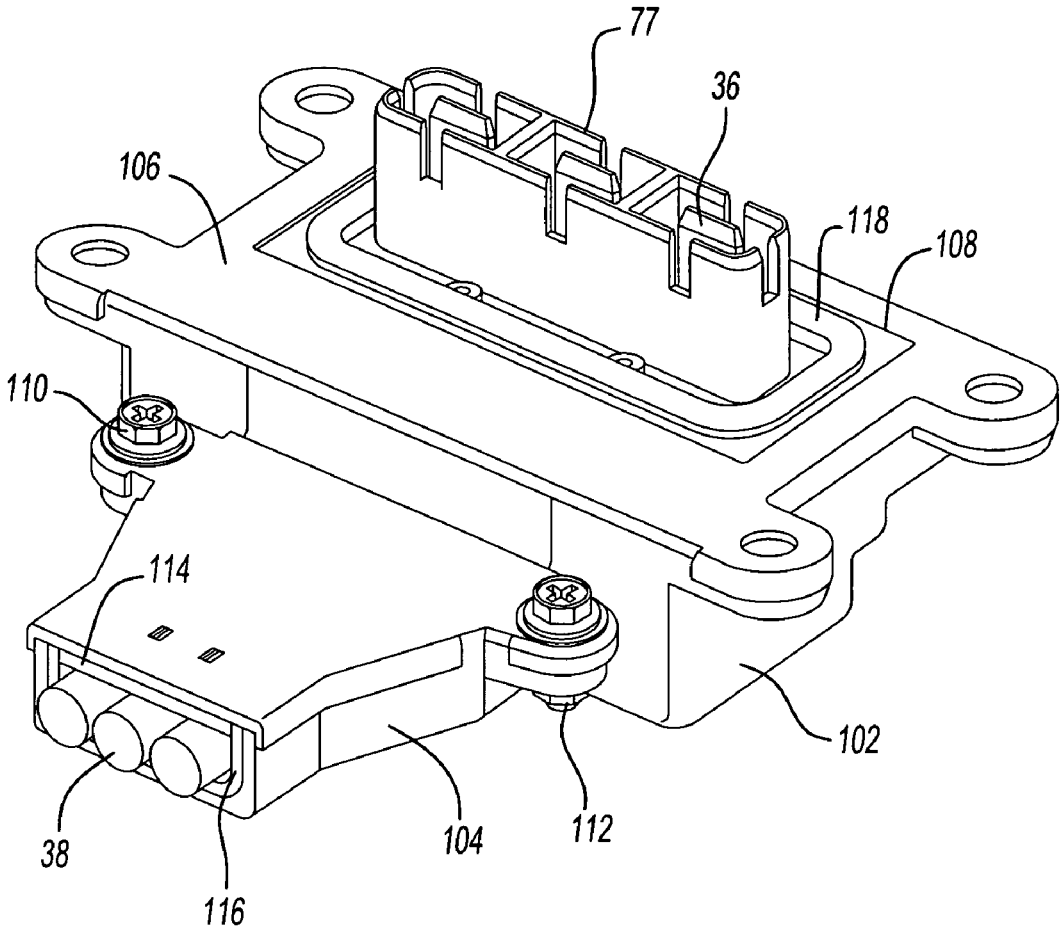
FIG. 6 is a view of the fully assembled connector assembly.

The surrounding parts of the connector assembly are then assembled around the first part 50, second part 70, and retained terminals 32. As illustrated in FIGS. 2 and 6, the connector assembly 30 includes an outer metal casing 102 for protecting the first and second connector parts and attaching the assembly to, for example, a vehicle transmission. The outer metal casing 102 shields the connector parts from electromagnetic interference. The casing 102 has a wire guide portion 104 and a cover portion 106. The cover portion 106 has an opening 108 sized to fit around the channel 79 in the base section 76 of the second connector part 70. The cover portion 106 is attached by bolts 110 (only some are shown) and nuts 112 to the casing 102. Rubber pieces 114 and 116 fit around the wires where they enter the wire guide portion 104, providing strain relief and preventing the wires from rubbing against the casing. A seal or gasket 118 fits into the channel 79 around the chamber section 77 of the second connector part 70 and would seal against the transmission or whatever device to which the connector assembly 30 directly mates.

Since minor changes and modifications varied to fit particular operating requirements and environments will be understood by those skilled in the art, this invention is not considered limited to the specific examples chosen for purposes of illustration. The invention is meant to include all changes and modifications which do not constitute a departure from the true spirit and scope of this invention as claimed in the following claims and as represented by reasonable equivalents to the claimed elements.

What is claimed is:

1. A connector assembly for receiving at least one electrical terminal having a wire-connect segment and an electrical mating segment extending at a right angle from the wire-connect segment, the connector assembly comprising;

a first part having an interior for receiving the at least one terminal through an insertion end, the interior including at least one member for supporting the wire-connect segment of the at least one terminal; and a second part having an inner compartment and an interior chamber extending at a right angle from the compartment for receiving the mating segment of the at least one terminal, the compartment having at least one member arranged to be opposite the at least one member in the interior of the first part when the first and second parts are assembled together such that the wire-connect segment of the at least one terminal is clamped between the at least one member in the interior of the first part and the at least one member in the compartment of the second part.

2. The connector assembly of claim 1 further comprising a latch means within the first part for snapping over protrusions from the at least one right-angle terminal to secure the at least one right-angle terminal in the first part prior to assembly with the second part.

3. A connector assembly for receiving at least one electrical terminal having a wire-connect segment and an electrical mating segment extending at a right angle from the wire-connect segment, the connector assembly comprising;

a first part having an interior for receiving the at least one terminal through an insertion end, the interior including at least one cradle-shaped member for supporting the wire-connect segment of the at least one terminal; and a second part having an inner compartment and an interior chamber extending at a right angle from the compartment for receiving the mating segment of the at least one terminal, the compartment having at least one cradle-shaped member arranged to be positioned opposite the at least one cradle-shaped member in the interior of the first part when the first and second parts are assembled together such that the wire-connect segment of the at least one terminal is clamped by the at least one cradle-shaped member in the interior of the first part and the at least one cradle-shaped member in the compartment of the second part.

4. The connector assembly of claim 3 wherein there are multiple cradle-shaped members in the interior of the first part and the compartment of the second part, and the members of the parts are aligned in a manner corresponding to a length of the wire-connect segment of the at least one terminal.

5. The connector assembly of claim 4 wherein there are multiple sets of aligned cradle-shaped members spaced across the interior of the first part and the compartment of the second part such that multiple terminals may be clamped in the connector assembly.

6. The connector assembly of claim 5 wherein the first part has a recessed ledge surrounding the interior and the second part has a raised portion within the compartment from which the cradle-shaped members extend, the raised portion being sized to fit within the interior over the ledge.

7. The connector assembly of claim 6 further comprising a seal for fitting between the raised portion and ledge, sealing the interior of the first part when the first and second parts are completely assembled.

8. The connector assembly of claim 3 wherein there are multiple cradle-shaped members across the interior of the first part and the compartment of the second part such that multiple terminals may be clamped in the connector assembly.

9. The connector assembly of claim 3 wherein the interior of the first part further includes inner walls with vertical grooves arranged to receive protrusions from the at least one terminal to guide the at least one terminal into a seated position within the interior and onto the at least one cradle-like member.

10. The connector assembly of claim 9 further comprising locking projections within the grooves to secure the at least one terminal in the seated position prior to assembling the second part on the first part.

11. The connector assembly of claim 3 further comprising an outer casing for enclosing the first and second parts.

12. The connector assembly of claim 11 wherein the outer casing includes a wire guide portion for fitting around electrical wires adjacent to where the wires enter the first part.

13. The connector assembly of claim 12 further comprising resilient elements within the wire guide portion positioned between the casing and the wires.

14. The connector assembly of claim 3 wherein the second part includes a channel around the interior chamber for receiving a gasket to seal the connector assembly against an electrically mating device.

15. A connector assembly for receiving at least one electrical terminal having a wire-connect segment and an electrical mating segment extending at a right angle from the wire-connect segment, the connector assembly comprising;

a first part having an interior for receiving the at least one terminal through an insertion end, the interior including at least one member having a concave surface for supporting the wire-connect segment of the at least one terminal; and a second part having an inner compartment and an interior chamber extending at a right angle from the compartment for receiving the mating segment of the at least one terminal, the compartment including at least one member having a concave surface, the at least one member in the compartment arranged to be positioned opposite the at least one member in the interior of the first part when the first and second parts are assembled together such that the wire-connect segment of the at least one terminal is clamped between the concave surfaces of the at least one member in the interior of the first part and the at least one member in the compartment of the second part.

16. The connector assembly of claim 15 wherein there are multiple members with concave surfaces in the interior of the first part and the compartment of the second part, each member in the interior having an opposite, matching member in the compartment.

17. The connector assembly of claim 16 wherein the members in the interior of the first part are formed integrally with the first part.

18. The connector assembly of claim 17 wherein the members in the compartment of the second part are formed integrally with a raised portion of a base section of the second part.

19. The connector assembly of claim 18 wherein the raised portion is received within the interior when the parts are assembled together.

20. The connector assembly of claim 15 further comprising a retention feature in the first part for holding the at least one terminal in the at least one member prior to assembly of the parts.

* * * * *